United States Patent [19]

Smith et al.

[11] 4,395,856

[45] Aug. 2, 1983

[54] POST AND PANEL MOUNTING SYSTEM

[76] Inventors: David L. Smith, 8912 NE. 80th St., Vancouver, Wash. 98662; Karen J. Clark, 658 1st St., Apartment B, Lake Oswego, Oreg. 97034; Donald G. Hatfield, 14740 SE. Barkley Ct., Boring, Oreg. 97009

[21] Appl. No.: 307,416

[22] Filed: Oct. 1, 1981

[51] Int. Cl.[3] ..... E04B 1/344

[52] U.S. Cl. ..... 52/239; 52/71; 160/135

[58] Field of Search ..... 52/239, 70, 71; 160/135, 229, 351

[56] References Cited

U.S. PATENT DOCUMENTS

| | | | |
|---|---|---|---|
| 2,915,151 | 12/1959 | Kekenak | 52/239 X |
| 3,353,314 | 11/1967 | Melcher . | |
| 3,365,851 | 1/1968 | Cushman . | |
| 3,400,958 | 9/1968 | Haimes . | |
| 3,559,352 | 2/1971 | Magnuson | 52/239 X |
| 3,683,576 | 8/1972 | Sikes . | |
| 3,722,157 | 3/1973 | Prokop . | |
| 3,731,956 | 5/1973 | Hanley . | |
| 3,762,116 | 10/1973 | Anderson et al. | 52/239 |
| 4,161,850 | 7/1979 | Peterson et al. | 52/239 X |
| 4,204,375 | 5/1980 | Good | 52/239 |

FOREIGN PATENT DOCUMENTS

| | | | |
|---|---|---|---|
| 205507 | 11/1956 | Australia | 52/239 |

*Primary Examiner*—J. Karl Bell

*Attorney, Agent, or Firm*—Klarquist, Sparkman, Campbell, Leigh, Whinston & Dellett

[57] ABSTRACT

A post and panel mounting system for assembling office partitions uses a hinge arrangement which enables the panels to be positioned at any desired angle to one another. The hinge includes a pivot member in a pivot bracket which is mounted in a narrow horizontal channel in the end of the panel. A radial arm connected to the pivot member protrudes from the channel and has an enlarged head which fits into a vertical slot in a post bracket on the post. Spaced a short distance along the radial arm from the head is an annular flange which abuts the post bracket to hold the panel at a fixed distance from the post. To angularly position the panel relative to the post, the panel is pivoted about the pivot member on an axis inside the end of the panel. The end of the panel is rounded so as to maintain close spacing between the post and panel at all angles.

9 Claims, 8 Drawing Figures

FIG. 3
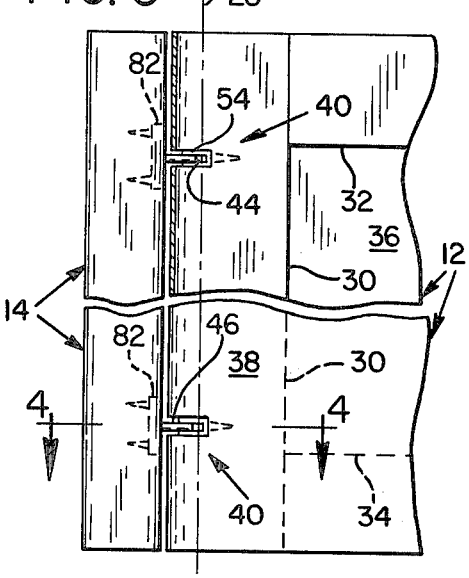
FIG. 2
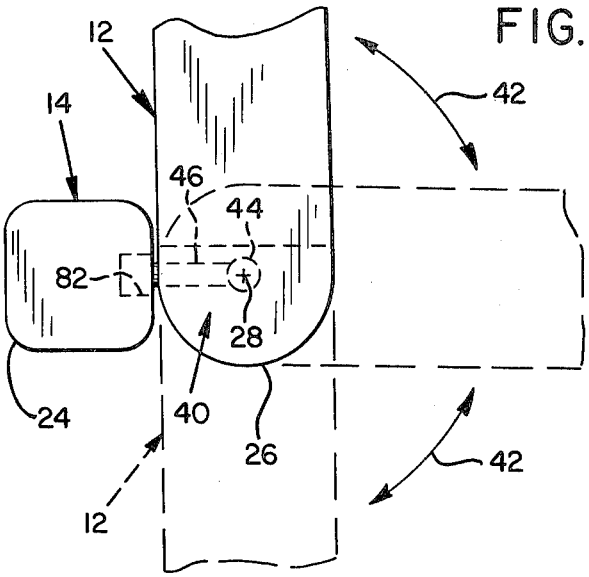
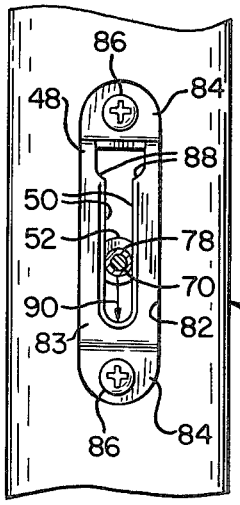
FIG. 6
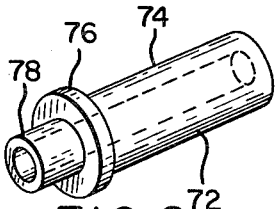
FIG. 8
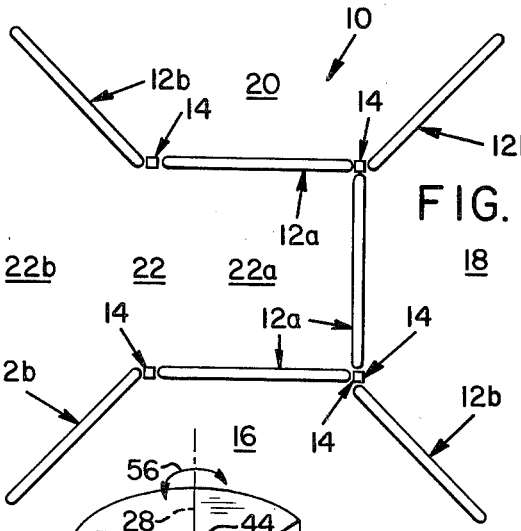
FIG. 1
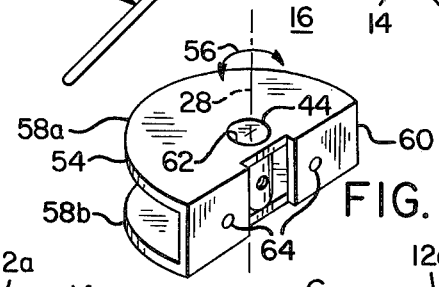
FIG. 7
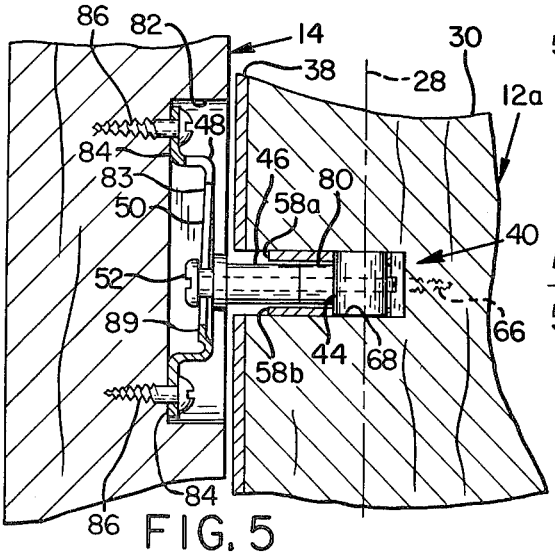
FIG. 5
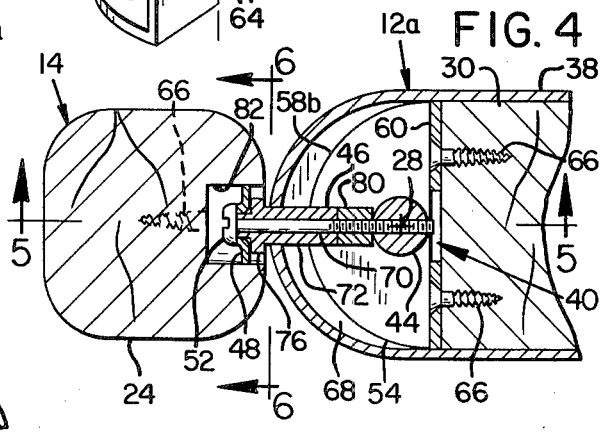
FIG. 4

POST AND PANEL MOUNTING SYSTEM

BACKGROUND OF THE INVENTION

This invention relates generally to office partitions and the like, and more particularly to mounting systems for assembling structural panels to form partitions of various configurations.

Modern offices make wide use of partitions to segregate work areas, dampen noise and create a pleasant working environment. Typically, these partitions are made up of multiple separate acoustical panels interconnected at their ends. Such a panel comprises a rectangular wooden framework supporting rectangular sheets of fibrous acoustical material and covered with fabric. For purposes of economy, these panels are usually manufactured in one or two uniform sizes and then assembled in the office to create an array of partitions of the desired size and configuration.

One difficulty is how to interconnect these panels. A common method of interconnecting them at their ends employs flat connector bars which are attached along the upper and lower horizontal edge faces of adjoining panels. A straight connector bar is used to interconnect two panels end to end in a straight line to form a wall. An angled connector bar is used to interconnect two panels at a right angle to form a corner. Similarly, a T-shaped connector bar is used to interconnect three panels.

This system has several drawbacks. First, it requires different kinds of connector bars to form walls, corners and joints between two or more panels. Second, it does not easily permit arranging the panels at other than right angles. To do so would require a different connector bar for each angle desired to be formed. Different connector bars are undesirable because it is uneconomical and, therefore, expensive to manufacture small volumes of many different angles. Likewise, it would be expensive for installers of such partitions to maintain an inventory of so many different connector bars and would unduly increase the labor costs of installing the partitions.

It would be preferable to have a panel mounting system which uses a single form of connector to interconnect panels at any desired angle. It would also be desirable for the system to require only minimal labor to assemble office partitions and not interfere with the aesthetic character of the partitions. However, no known panel mounting system offers these capabilities.

U.S. Pat. Nos. 3,365,851 to Cushman and 3,722,157 to Prokop disclose similar tongue and groove systems for interconnecting panels. These systems enable the panels to be interconnected end to end in a straight line. However, both systems appear to be limited to interconnecting panels in straight lines or at right angles to one another.

U.S. Pat. Nos. 3,683,576 to Sikes and 3,731,956 to Hanley disclose another system for interconnecting panels. Both systems utilize a form of slot in one panel or in a separate connector for receiving a locking bolt in the other panel for quickly joining the panels together to assemble a partition. Both systems are usable to form straight line walls and right angle corners but require different connectors for each such application. Moreover, neither system enables forming obtuse or acute angle corners between the panels.

U.S. Pat. Nos. 3,353,314 to Melcher and 3,400,958 to Haimes, et al. disclose panel-connecting systems which employ both a tongue and groove arrangement and interlocking connector housings imbedded in the panels. Either straight line or right angle corners can be formed using the same connectors. However, other than straight line and right angle interconnections cannot be made between panels with these mounting systems.

Accordingly, there remains a need for a panel mounting system which would enable panels to be assembled at any desired angle using only a single form of connector.

SUMMARY OF THE INVENTION

It is therefore one object of the invention to provide an improved system of assembling panels to form office partitions.

The second object of the invention is to interconnect panels in other than straight line and right angle relationships.

Another object of the invention is to eliminate the need for different forms of connectors to interconnect panels at different angles.

A further object is to enable the interconnection of two panels end to end at any desired angle to one another with only one form of connector.

Yet another object of the invention as aforesaid is to enable fixing a panel at any desired angle relative to an adjacent panel and holding it substantially immobile in that position until it is desired to change its position.

To fulfill these objects, the invention provides for a post and panel mounting system in which adjacent ends of panels are pivotally interconnected about an upright post. The panels, which preferably have rounded ends, are provided with a special form of hinge means which is countersunk into the vertical frame member forming the end of the panel. The hinge means includes a vertical pivot member, a radial member protruding horizontally from the side of the pivot member and connecting means for connecting the end of the radial member to the post. This system enables the panel to pivot about a vertical axis inside the panel, for example, at the axis of curvature of the rounded end of the vertical frame member.

The connecting means preferably includes a post bracket countersunk in the face of the post. The post bracket includes means defining a narrow vertical slot with a wide mouth at the top. The radial member has an enlarged head which just fits into the mouth of the slot and a shaft or body sized to slide down the narrow lower portion of the slot. The radial member preferably has an annular flange spaced a short distance apart from the enlarged head for abutting the face of the post bracket to hold the panel at a fixed distance from the post. These features enable the post and panel system to be easily assembled into a rigid array of partitions. They also enable the array to be easily erected and disassembled.

The hinge means also preferably includes a pivot bracket sized to fit within a narrow horizontal slot in the end of the vertical frame member to retain the pivot member therein. This feature allows the hinge means to be hidden beneath the panel covering with only the radial member protruding through a slit in the covering. The hinge means can also be arranged to provide frictional engagement between the radial member and the side of the bracket so that the panel does not swing freely on the post. This feature tends to further rigidify the structure of the partitions.

The invention thus provides office designers with a flexibility in arranging office partitions which was not heretofore available. The designer is not limited to positioning panels only along straight lines and right angles, but can choose any desired angle. Using this system, the installer can quickly and easily install an array of office partitions without tools. If the position of the panel is not quite right, he can simply rotate it a few degrees about the post. The panel will remain in place until it is again deliberately moved.

The foregoing and other objects, features and advantages of the invention will become more apparent from the following detailed description of a preferred embodiment of the invention, which proceeds with reference to the accompanying drawing.

BRIEF DESCRIPTION OF THE DRAWING

FIG. 1 is a top plan view of an array of office partitions employing the post and panel mounting system of the invention.

FIG. 2 is an enlarged top plan view of one post and panel of the array of FIG. 1, the panel being shown in phantom lines in various alternative positions relative to the post.

FIG. 3 is a side elevational view of the post and panel of FIG. 2, the fabric covering being cut away from the upper portion of the panel to reveal interior features.

FIG. 4 is a further enlarged cross-sectional view taken along line 4—4 in FIG. 3.

FIG. 5 is a cross-sectional view taken along line 5—5 in FIG. 4.

FIG. 6 is a cross-sectional view taken along line 6—6 in FIG. 4, showing the post bracket in front elevational view.

FIG. 7 is a perspective view of the panel bracket and pivot member employed in the hinge of the mounting system of FIGS. 1-6.

FIG. 8 is a perspective view of the sleeve employed in the hinge of the mounting system of FIGS. 1-6.

DETAILED DESCRIPTION OF PREFERRED EMBODIMENT

Referring to FIG. 1, an illustrative array 10 of office partitions is assembled from seven individual acoustical panels 12 interconnected along their ends by four posts 14 arranged in a square pattern to form four separate work areas 16, 18, 20, 22. Three panels **12*a* are interconnected at right angles between the posts to form a square enclosed portion 22*a* of work area 22. The four remaining panels 12*b* are each connected along one end to a post, and positioned at, for example, 135° angles from panels 12*a* so as to form nonsquare work areas 16, 18, 20 and a vestibule portion 22*b* of work area 22**.

Referring to FIGS. 2, 3, and 4, the posts are upright wooden members having a generally square cross section, preferably with rounded corners 24. The panels are flat members with a vertical end face 26 at each end which is generally rounded, preferably about a semicircular arc having a vertical axis of curvature 28.

Each panel has an interior frame structure comprising parallel vertical frame members 30 at each end of the panel interconnected by upper and lower horizontal frame members 32, 34. Sheets of conventional acoustical material 36 are supported inside this framework. Covering each panel is a layer of decorative fabric 38, best seen in FIGS. 4 and 5. The upright members 30 are rounded on their ends adjacent the posts so as to provide, when covered by fabric 38, the rounded shape of the end faces 26.

Hinge means 40 removably connect the panels to the posts for rotation about a vertical axis within the body of the panel. Preferably, this axis of rotation coincides with the axis 28 of curvature of end face 26. The hinge means enables the panels to be positioned anywhere within a radius of 180° about the post, as shown in phantom lines and by arrows 42 in FIG. 2. Each panel is connected to a post by at least two hinge means, one positioned near the upper corner of the panel and another near the lower corner of the panel.

Referring to FIGS. 4 and 5, hinge means 40 includes a pivot member 44 positioned to rotate about vertical axis 28 and a radial member 46 extending horizontally from a side of the pivot member toward the post. The radial member 46 is detachably connected to the post by connecting means including a post bracket 48 including a slot 50 for receiving an enlarged end 52 of the radial member.

Referring to FIG. 7, the pivot member 44 is a short cylindrical metal rod mounted in a pivot bracket 54 for rotation around axis 28, as indicated by arrow 56. The pivot bracket has a pair of semicircular upper and lower sidewalls **58*a*, 58*b* spaced apart and interconnected by a base wall 60 to form a narrow channel. The pivot member extends across the channel normal to sidewalls 58*a*, 58*b* and the ends of the pivot member are loosely received in circular holes 62 in the sidewalls. A pair of screw holes 64 are located in base wall 60 on opposite sides of the pivot member. The sidewalls of the pivot bracket are spaced closely together so that the bracket will fit easily into a narrow horizontal slot or channel 68 cut into frame member 30 at the ends of the panel. Screws 66 secure the pivot bracket to vertical frame member 30 at the bottom of channel 68, as shown in FIGS. 4 and 5**.

The radial member 46 comprises a long screw whose shaft 70 is threaded into pivot member 44 and whose head forms the enlarged end 52 of the radial member. A tubular sleeve 72, best seen in FIG. 8, is received on the shaft of the screw. Most of the length of the sleeve is made up of a large-diameter cylindrical portion 74 sized to fit between sides **58, 58*b* of the pivot bracket 54. Preferably, portion 74 is sized to fit snugly between the sidewalls 58*a*, 58*b* so as to provide some frictional engagement therealong to prevent the panel from swinging freely and thereby further rigidify the assembled array of partitions. This frictional engagement means can be provided in other ways as well, for example, by offsetting the radial member 46 along the length of the pivot member so as to frictionally engage one of walls 58*a*, 58*b***.

The end of sleeve 72 opposite the pivot member includes a flange 76 and a short cylindrical segment 78 which abuts against the base of the screw head 52 to space the flange apart therefrom. Segment 78 is sized to fit snugly within slot 50 of post bracket 48. The annular flange 76 is positioned between segments 74 and 78. Segment 78 is sized so that the flange abuts the post bracket and thereby holds the panel rigidly at a fixed distance from the post.

The sleeve member can be made in different lengths for use with panels of different thicknesses and different radii of curvature along the face 26. Alternatively, a single length sleeve 72 may be used either alone with one size panel or in conjunction with a short tubular segment 80 received on screw shaft 70 for larger size panels, as shown in FIGS. 4 and 5. As yet another alternative, the radial member can be a unitary part. In one preferred example, the screw and sleeve member are integrated into a single steel turning having the profile of radial member 46, as shown in FIG. 6.

Referring to FIGS. 5 and 6, the post bracket 48 is inset into a vertically-elongated channel 82 in a face of post 14. The bracket includes a raised central portion 83 containing slot 50 and a mounting ear 84 at each end. Screws 86 extend through the ears into the post as the bottom of channel 82. The uppermost end of slot 50 is wider than the rest of the slot to form a mouth 88 for receiving the enlarged end 52 of radial member 46 in the bracket. The raised portion is indented around the slot to provide a camming surface 89 inclined from vertical so as to pull the end 52 toward the post as it slides downwardly in the slot. This feature rigidifies the interconnection between the radial member and the post.

Operation

The post and panel mounting system of the present invention enables panels 12 to be quickly assembled on upright posts 14 to form an array of partitions, of which FIG. 1 is only one example. To connect a panel to an adjacent post, the enlarged end 52 of radial member 46 of each hinge means 40 on one end of the panel is inserted into the mouth 88 of slot 50 in a corresponding post bracket on the post. The radial members of the hinge means then slide down along their respective slots, as indicated by arrow 90 in FIG. 6, to securely interconnect the post and panel.

The panel can then be positioned at any desired angle within the range of about 180° by swinging the panel about axis 28, as indicated by arrows 42 in FIG. 2. Once positioned, the panel remains where it was placed by virtue of the frictional engagement between the radial member and the pivot bracket. In assembling the array of partitions, if one panel is not in a desired location, it can easily be swung a few degrees or many degrees, as necessary, to place the panel where the user wants it. This capability is extremely helpful when positioning an array of partitions relative to existing architectural features, such as doorways and walls. It is also very helpful in trying to fit office equipment and furniture into work areas. The size of the work area can be altered easily by moving the partitions.

Having illustrated and described a preferred embodiment of my invention, it should be apparent to those skilled in the art that the invention can be modified in arrangement and detail. I claim all modifications falling within the scope and spirit of the following claims.

I claim:

1. A post and panel mounting system for partitioning an office comprising:

a vertical post;

a panel including a vertical frame member along an end thereof; and hinge means for pivotably connecting the panel to the post along the end of the panel so that the panel can be selectably positioned angularly relative to the post; the hinge means including:

a vertical pivot member positioned in the frame member for rotation about a vertical pivot axis within the panel;

a radial member connected to the pivot member and extending horizontally outwardly therefrom; and connecting means for connecting an end of the radial member to the post.

2. Apparatus according to claim 1 including a post bracket mounted on a face of the post, the connecting means including means for connecting the end of the radial member to the post bracket.

3. Apparatus according to claim 1 in which the panel has a rounded end face and the vertical pivot member is positioned at substantially the axis of curvature of said end face.

4. Apparatus according to claim 2 in which the connecting means includes an enlarged head at the end of the radial member and the post bracket includes means defining a vertical slot which is narrower than the enlarged head and has a widened upper portion, so that the head can be inserted in the slot to removably retain the end of the radial member therein.

5. A hinge for a post and panel office partitioning system comprising:

a pivot bracket for mounting in a slot in an end of said panel, including a narrow base wall and a pair of parallel sidewalls spaced apart to define a narrow channel therebetween;

a pivot member extending lengthwise between said sidewalls and mounted for rotation relative thereto about a pivot axis;

a radial member connected to a side of the pivot member and extending outwardly therefrom approximately parallel to said sidewalls, the radial member having a free end protruding beyond at least a portion of the pivot bracket;

a post bracket for mounting on a face of the post adjacent the end of said panel; and connecting means for connecting the free end of the radial member to the post bracket.

6. Apparatus according to claim 5 in which the radial member comprises:

a cylindrical shaft normal to the pivot member;

a first annular flange means at the end of the radial member for retaining the radial member in a slot in the post bracket; and a second annular flange means spaced apart along the length of the shaft from the first flange means for abutting the front of the post bracket to hold the panel at a fixed distance away from the pivot axis of the pivot member; and the post bracket comprises vertical slot means for receiving the first flange means.

7. Apparatus according to claim 5 in which the radial member comprises:

a screw threaded into a screw hole in the pivot member; and a hollow, cylindrical sleeve member received on the shaft of the screw;

the sleeve member including an annular flange spaced a short distance apart from the head of the screw.

8. Apparatus according to claim 5 in which the post bracket includes means defining a vertical slot having an opening at its upper end and the radial member comprises a unitary member including:

a cylindrical shaft;

a screw portion concentrically positioned on one end of the shaft and of a lesser diameter for threading the member into the pivot member;

a first annular flange at the end of the shaft opposite the screw portion, and a second annular flange spaced along the shaft away from the first flange, a distance such that the flanges clamp tightly on opposite sides of the post bracket when the shaft is positioned in the slot.

9. Apparatus according to claim 5 in which the radial member and pivot bracket include frictional engaging means for yieldably fixing the radial member in a selected angular position in the pivot bracket.

* * * * *